US010420706B2

(12) United States Patent
Lee

(10) Patent No.: US 10,420,706 B2
(45) Date of Patent: Sep. 24, 2019

(54) SAFE TABLET CUTTING DEVICE

(71) Applicant: E-LINK PLASTIC & METAL INDUSTRIAL CO., LTD., New Taipei (TW)

(72) Inventor: Chih-Chun Lee, New Taipei (TW)

(73) Assignee: E-LINK PLASTIC & METAL INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 16/048,323

(22) Filed: Jul. 29, 2018

(65) Prior Publication Data

US 2018/0333333 A1 Nov. 22, 2018

Related U.S. Application Data

(63) Continuation-in-part of application No. 15/372,339, filed on Dec. 7, 2016, now abandoned.

(51) Int. Cl.

| | |
|---|---|
| ***A61J 7/00*** | (2006.01) |
| ***B26D 1/30*** | (2006.01) |
| ***B26D 5/10*** | (2006.01) |
| ***B26D 7/01*** | (2006.01) |
| ***B26D 7/22*** | (2006.01) |
| ***B26D 3/30*** | (2006.01) |

(52) U.S. Cl.

CPC ..... *A61J 7/0007* (2013.01); *B26D 1/30* (2013.01); *B26D 3/30* (2013.01); *B26D 5/10* (2013.01); *B26D 7/01* (2013.01); *B26D 7/22* (2013.01)

(58) Field of Classification Search

CPC ..... A61J 7/0007; B26D 3/30; B26D 7/01; B26D 1/30; B26D 5/10; B26D 7/22; Y10T 225/371; Y10T 83/7918; Y10T 225/379; Y10T 83/8809; Y10T 225/386; Y10T 29/49826; Y10T 83/872; Y10T 225/393; Y10T 225/10; Y01T 83/606

USPC ..... 225/103, 104.102, 105, 106, 93; 83/397, 83/544, 605–607, 609, 673, 675, 398, 83/487; 30/124, 120.1; 220/810–813, 220/345.1, 351, 254.3, 354.6, 254.9, 255

See application file for complete search history.

(56) References Cited

U.S. PATENT DOCUMENTS

| | | | | |
|---|---|---|---|---|
| 6,557,945 | B1 * | 5/2003 | Eric | A61J 7/0007 30/124 |
| 7,243,826 | B2 * | 7/2007 | Darst | A61J 7/0007 225/103 |
| 7,673,778 | B2 * | 3/2010 | Sze | A61J 7/0007 225/103 |

(Continued)

*Primary Examiner* — Ghassem Alie
(74) *Attorney, Agent, or Firm* — Leong C. Lei

(57) ABSTRACT

A safe tablet cutting device includes a container, a cover, a cutter, and a suspension body. A platform in the container provides tablet positioning. First and second positioning elements are configured between a back end of the container and the platform. The cover is hinged to the back end of the container. The suspension body has its back end freely rotatable but confined between the first and second positioning elements when the cover is opened or closed. The suspension body has a slot opening corresponding to the cutter configured on the inside of the cover so that the cutter is properly concealed behind the suspension body and, when the cover is closed, gradually exposed to cut the tablet. The safety and applicability of the tablet cutting device is as such enhanced.

9 Claims, 11 Drawing Sheets

(56) References Cited

U.S. PATENT DOCUMENTS

| | | | | |
|---|---|---|---|---|
| 7,828,181 | B1 * | 11/2010 | Reitano | B26D 3/30 225/1 |
| 2014/0311304 | A1 * | 10/2014 | Noble | A61J 7/0007 83/13 |
| 2017/0128324 | A1 * | 5/2017 | Muller | B26D 1/26 |

* cited by examiner

SAFE TABLET CUTTING DEVICE

CROSS-REFERENCE TO RELATED APPLICATIONS

This application is a continuation-in-part of patent application Ser. No. 15/372,339, titled "Safe Tablet Cutting Device," which is hereby incorporated herein by reference in its entireties.

BACKGROUND OF THE INVENTION (a) Technical Field of the Invention

The present invention is related to pill cutters, and particularly to a safe tablet cutting device provided with a suspension body with an opening through which a cutter may run, thereby preventing a user from being cut.

(b) Description of the Prior Art

Generally, to effectively carry tablets for easy taking, tablets are placed in a tablet box.

However, a conventional tablet box is merely a box. An accommodation space is formed inside the box, where the tablets are placed. However, the tablets often have to be taken according to a specific dosage, and sometimes some tablets cannot be taken as a whole. These tablets must be divided and taken only one half or even one quarter of them by means of cutting or splitting for the required dosage per meal or per day. Thus, when the user needs to divide the tablet, the tablet will be likely to be contaminated by his or her unclean hands, thereby making the user not feel good or compromising the effect or quality of the tablets. Further, if the user cut the tablet by using an external cutter and the cutter is improperly operated, the tablet may easily fall to the ground, or the user might cut his or her finger(s) if the user is careless or neglectful.

In this way, in order to avoid the above shortcomings, there have been tablet boxes introduced in the market to help the user cut the tablets. However, these conventional tablet boxes are provided with an exposed cutter and the majority of the users using them is the elderly; thus, they often cut their finger(s) due to poor eyesight or their obtuse action.

Thus, to solve the drawbacks mentioned above, U.S. Pat. No. 8,474,674 B2, titled Tablet Cutter, and US Publication No. US20070228053 A1, titled Pill Box and Splitter with Blade Guard, are disclosed. According to their teachings, a plate may be slid in the tablet box along sliding rails and the plate may hide a cutter when the tablet box is open. However, friction between the plate and the sliding rail may cause wear and operation difficulty. In addition, the cutter is isolated by a flexible piece, and the flexibility of the piece may suffer fatigue after a period of time, resulting in ineffective isolation to the cutter. Therefore, there is still room for improvement for the above teachings.

On the other hand, U.S. Pat. No. 7,243,826 B2 titled Pill Box and Splitter with Blade Guard has a movable blade guard that is prone to damage. U.S. Pat. No. 6,557,945 B1 title Tablet Cutter raises a blade from one end so that the other end of the blade descends to cut a pill. The blade may become loose and its cutting capability is reduced.

SUMMARY OF THE INVENTION

Therefore, in order to avoid the user from being cut, the present invention provides a safe tablet cutting device, improving the safety of use and eliminating the drawbacks of the prior art.

In order to achieve the aforementioned purpose, the present invention provides a safe tablet cutting device, mainly includes a container, a cover, a cutter, and a suspension body. A top side of the container is opened and the other sides of the container are enclosed, thereby forming an accommodation space. A platform is provided in the container for placing a tablet. A first positioning element is disposed to a back end of the platform. A second positioning element is disposed in the accommodation space between the first positioning element and a back end of the container. A first fastening element is provided at a front end of the container. A back end of the cover is hinged to the back end of the container so that the cover selectively opens or closes the accommodation space. A second fastening element is provided at a front end of the cover for detachably engaging the first fastening element. Two axle holes are provided on the inside of the cover adjacent to the second fastening element. The cutter is provided on the inside of the cover. When the cover closes the container, the cutter is pushed towards the platform. A front end of the suspension body is configured with an axle whose two ends are joined to the axle holes, respectively. The suspension body swivels around the axle. A back end of the suspension body is confined between the first and second positioning elements and when the cover is opened. A slot opening is provided on the suspension body beneath the cutter so that the cutter penetrates the slot opening and reaches the platform when the cover is closed.

At least a reinforcement element is provided on a top side adjacent to the back end of the suspension body. The purpose of the reinforcement element is to enhance the strength of the suspension body.

A compartment is provided inside the container beneath the platform for collecting the crumbs from the tablet being cut.

The foregoing objectives and summary provide only a brief introduction to the present invention. Other objects, features, and advantages of the present invention will become conspicuous to those skilled in the art upon reading the following detailed descriptions accompanying by the illustrations.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
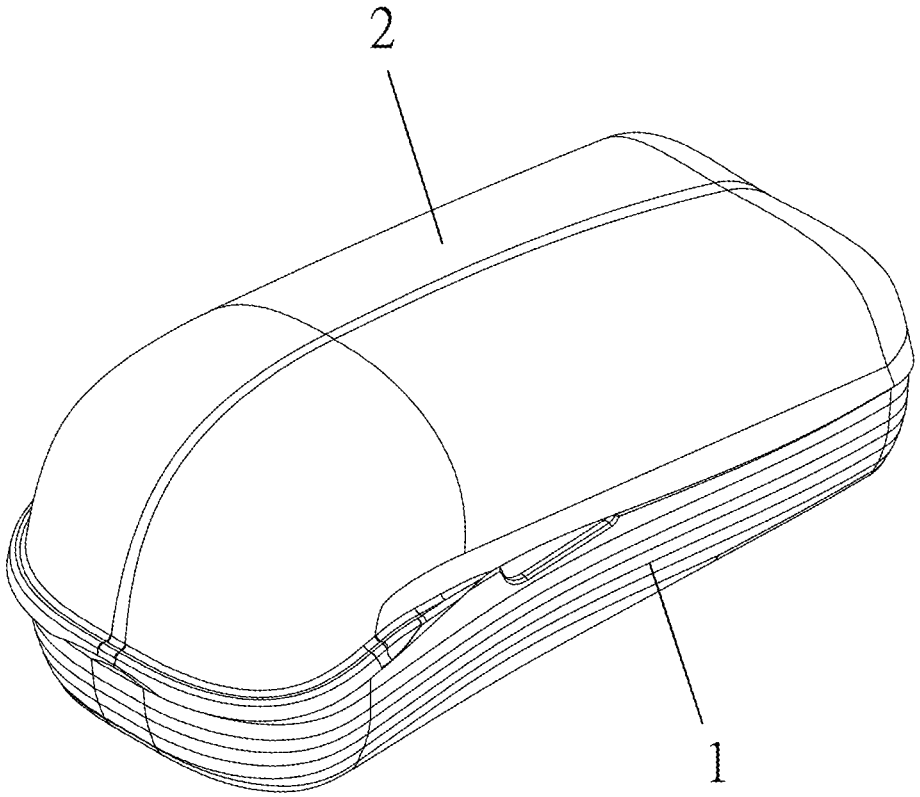
FIG. 1 is a perspective diagram showing a tablet cutting device according to an embodiment of this invention.
Figure 2:
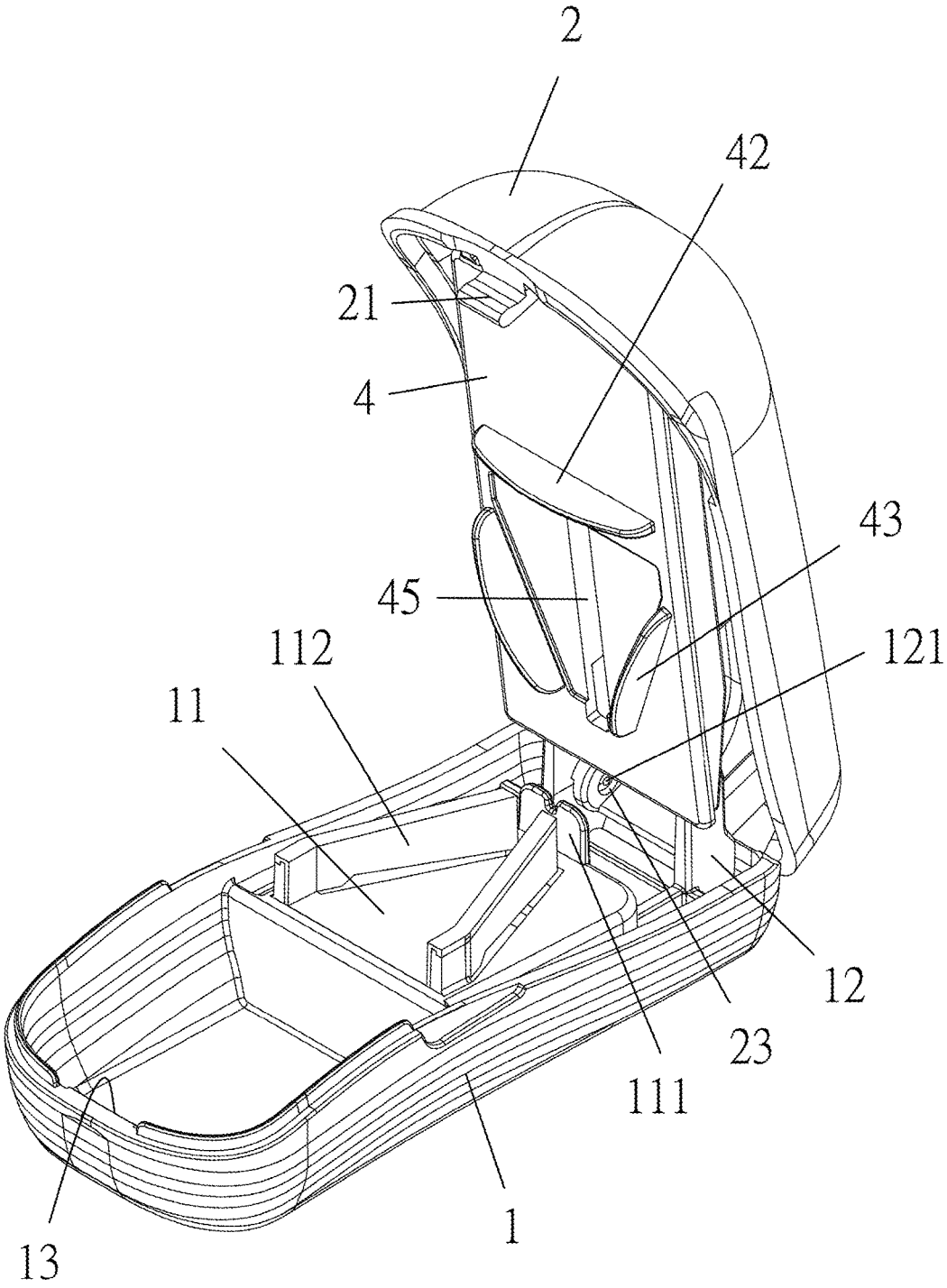
FIG. 2 is a perspective diagram showing the tablet cutting device of FIG. 1 with its cover opened.

As shown in FIGS. 1 and 2, a safe tablet cutting device according to an embodiment of this invention includes a container 1, a cover 2, a cutter 3, and a suspension body 4. A top side of the container 1 is opened and the other sides of the container 1 are enclosed, thereby forming an accommodation space. A platform 11 is provided in the container 1 where a tablet is placed. The platform 11 includes a first positioning element 111 joined to a back end of the platform 11 and a V-shaped stopper 112 disposed on a top side of the platform 11. The platform 11 and the stopper 112 are made of an anti-slippery material. A compartment 113 is formed beneath a bottom side of the platform 11 for collecting crumbs from the tablet being cut. A second positioning element 12 is disposed in the accommodation space between the first positioning element 111 and a back end of the container 1. A first fastening element 13 is provided at a front end of the container 1. The cover 2 is hinged to the back end of the container 1 so as to open or close the top side of the container 1.

In an embodiment, the first positioning element 111 is a flat piece extended upward from a back end of the platform 11. The second positioning element 12 includes two opposite flat pieces separated at a distance.

Furthermore, a first pivot element 121 is configured on the second positioning element 12. The first pivot element 121 may be two pins, one on each flat piece. A second pivot element 23 is configured to the back end of the cover 2. The second pivot element 23 includes two flat pieces extended downward towards the first pivot element 121, each configured with a pin hole. As such, the first and second pivot elements 121 and 23 may be coupled by plugging the pins into the pin holes, respectively. The cover 2 is therefore hinged to the container 1. Through the first and second pivot elements 121 and 23, the cover 2 may expose or seal the accommodation space of the container 1.

As shown in FIGS. 1 to 4, a second fastening element 21 is provided at a front end of the cover 2 for engaging the first fastening element 13. Two axle holes 22 are provided on the inside of the cover 2 adjacent to the second fastening element 21. The cutter 3 is provided on the inside of the cover 2. When the cover 2 closes the container 1, the cutter 3 is pushed towards the platform 11.

Figure 3:
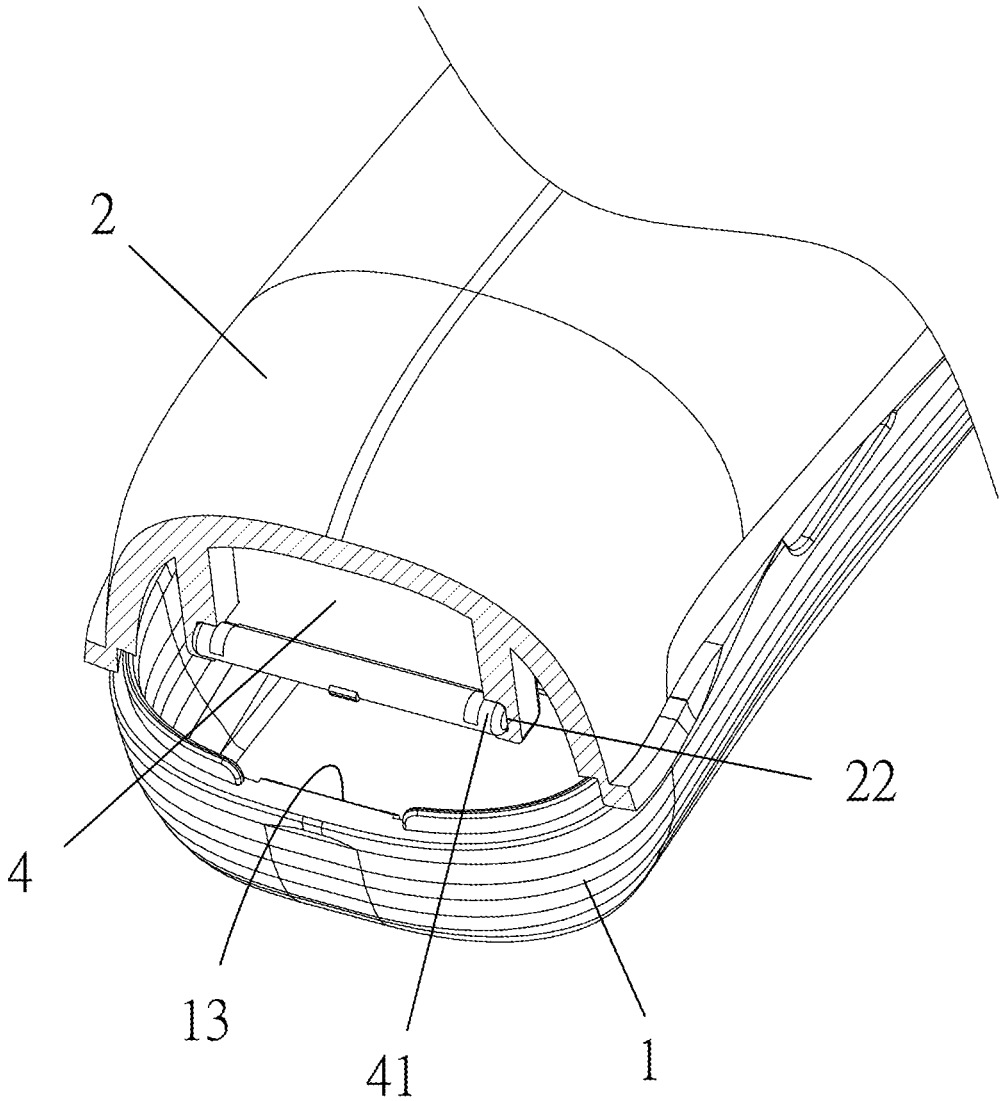
FIG. 3 is a partial cross-sectional diagram showing a front portion of a cover of the tablet cutting device of FIG. 1.
Figure 4:
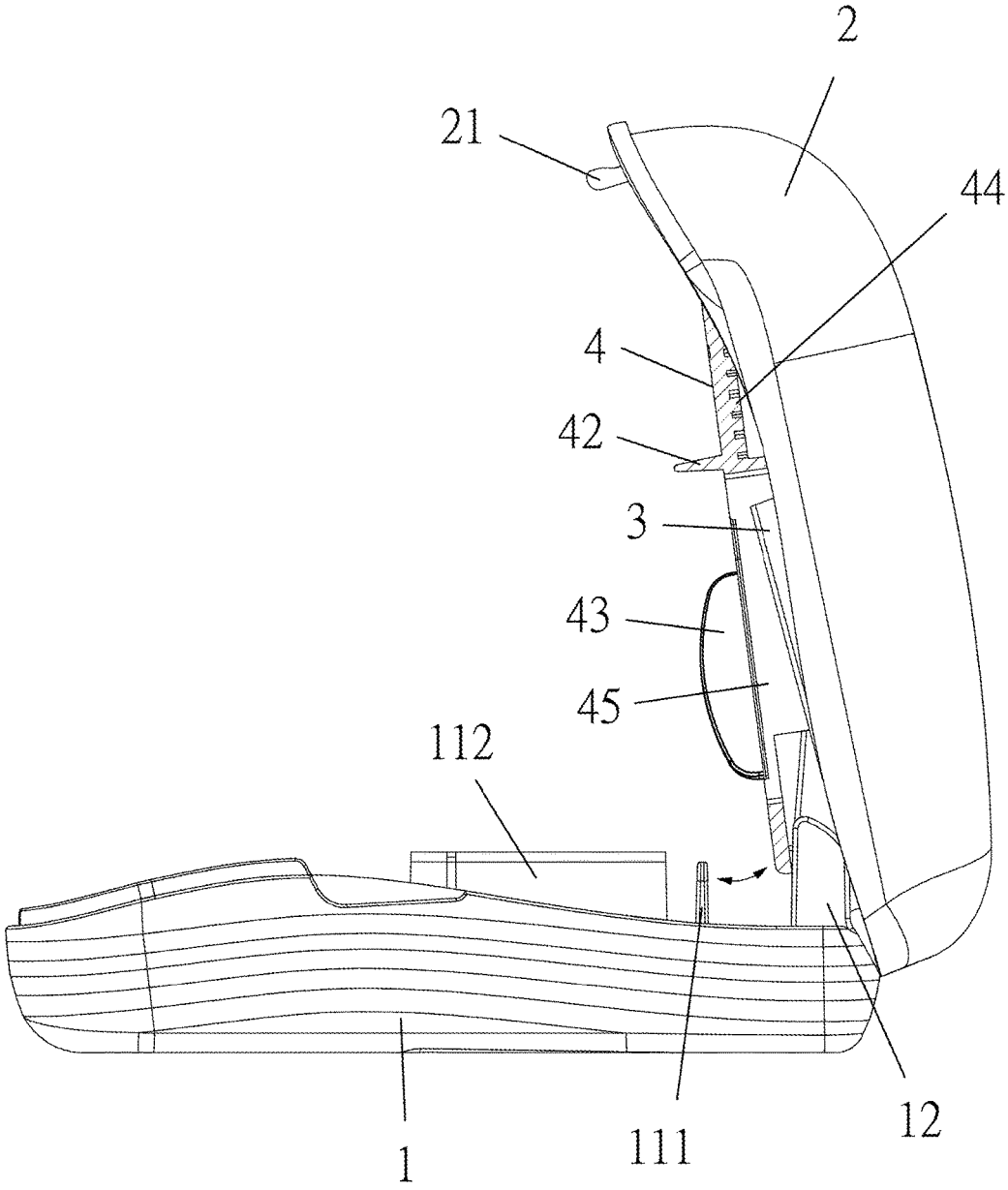
FIG. 4 is a side-view diagram showing the tablet cutting device of FIG. 2.

As shown in FIGS. 2 to 4, a front end of the suspension body 4 is configured with an axle 41 whose two ends are joined to the axle holes 22. The suspension body 4 as such may swivel around the axle 41 and a back end of the suspension body 4 is confined between the first and second positioning elements 111 and 12 when the cover 2 is opened.

Figure 5:
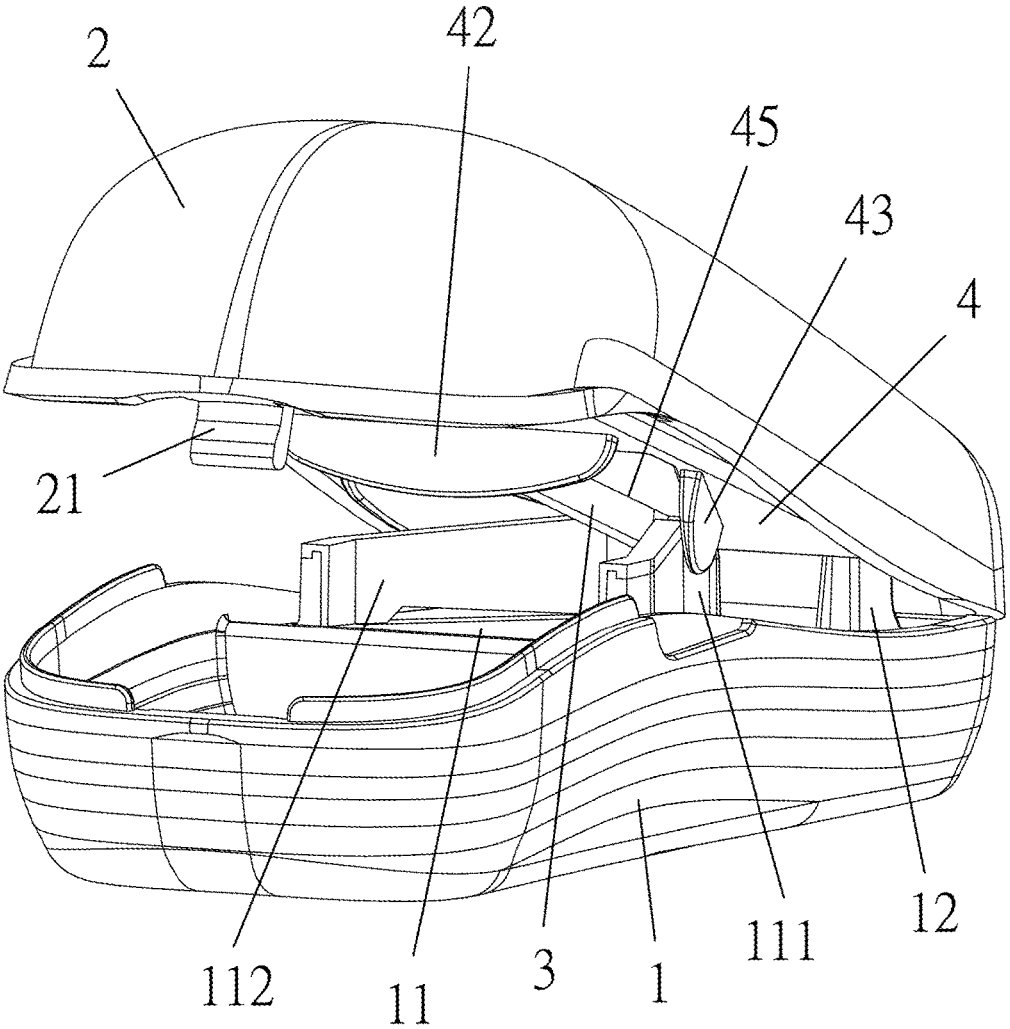
FIG. 5 is a perspective diagram showing the tablet cutting device of FIG. 1 with its cover partially opened.
Figure 6:
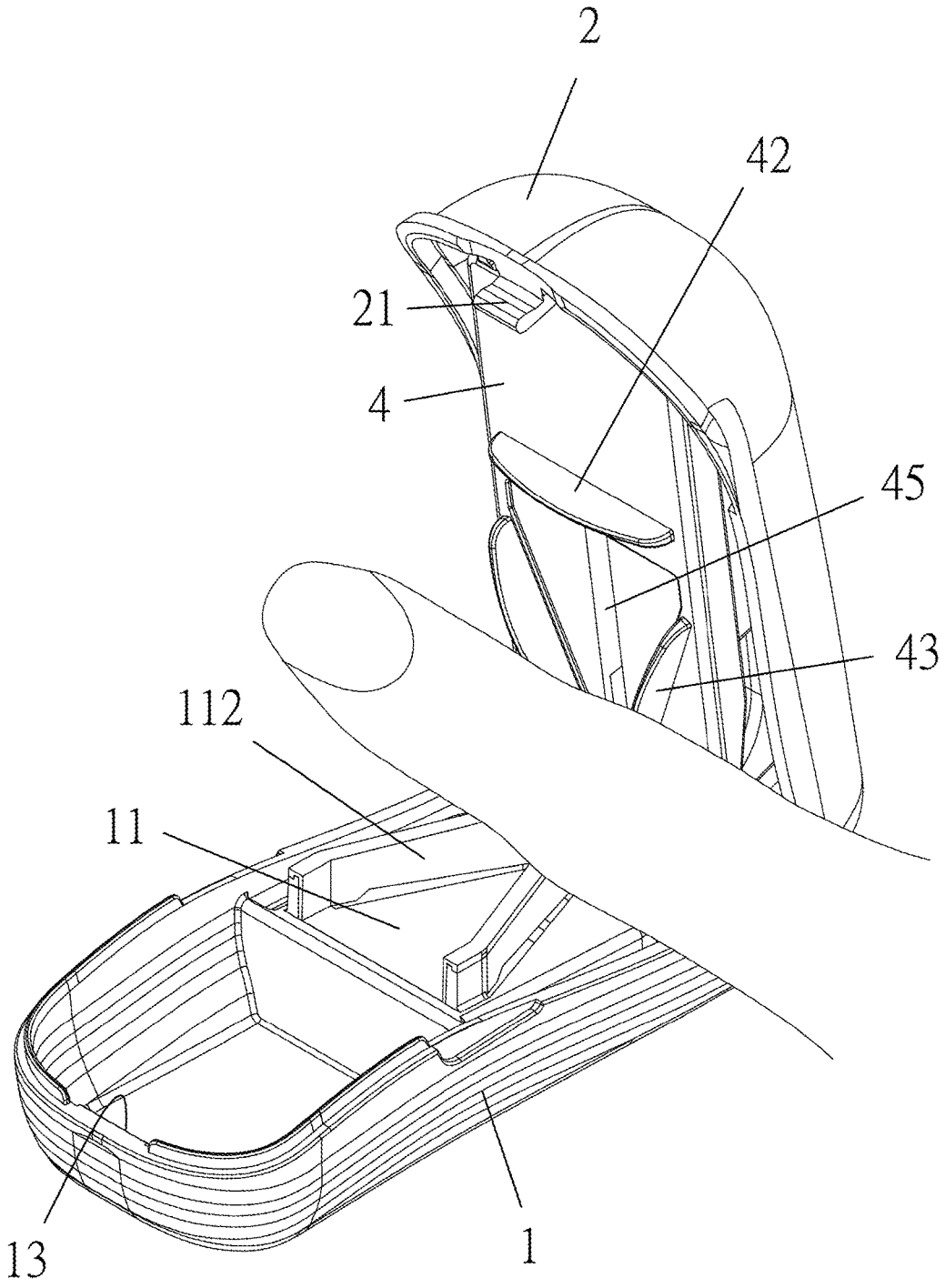
FIG. 6 is a schematic diagram showing flinger: protection provided by the tablet cutting device of FIG. 1.

As shown in FIGS. 2, 4, and 5, a bottom side of the suspension body 4 that faces the platform 11 is configured with a primary protection element 42 and two secondary protection elements 43. When the cover 2 closes the container 1, the first protection element 42 would be adjacent to a front end of the platform 11 and the second protection elements 43 are outside the stopper 112. When the back end of the suspension body 4 is pressed against the second positioning element 12, the first and second protection element 42 and 43 may further prevent the user from contacting the cutter 3 and cutting his/her finger. The purpose of the first and second protection element 42 and 43 is to enhance the safety of the tablet cutting device so that, when a finger is on the platform 11 as the cover 2 is closed, the primary and secondary protection element 42 and 43 will contact the finger first and prevent it from being cut by the cutter 3, as shown in FIG. 6.

Figure 9:
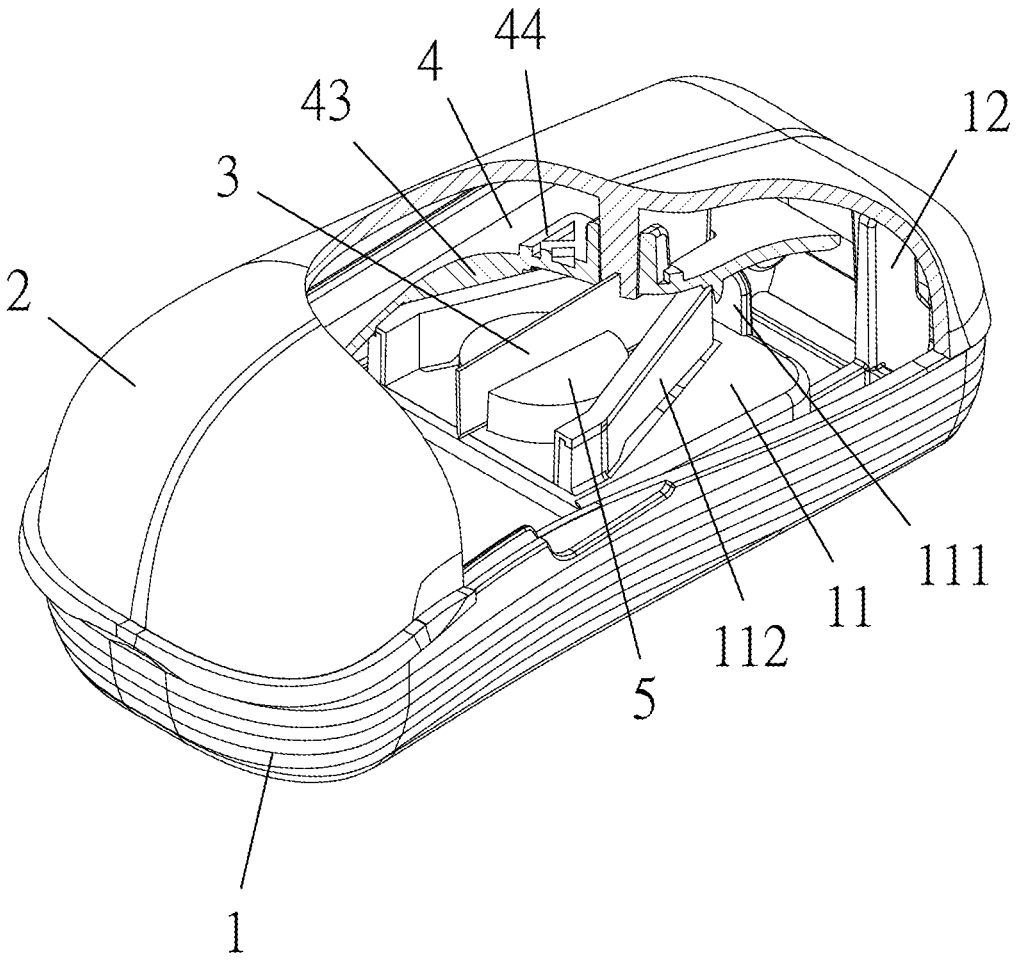
FIG. 9 is a schematic diagram showing a tablet being cut by the tablet cutting device of FIG. 1 when it is closed.
Figure 10:
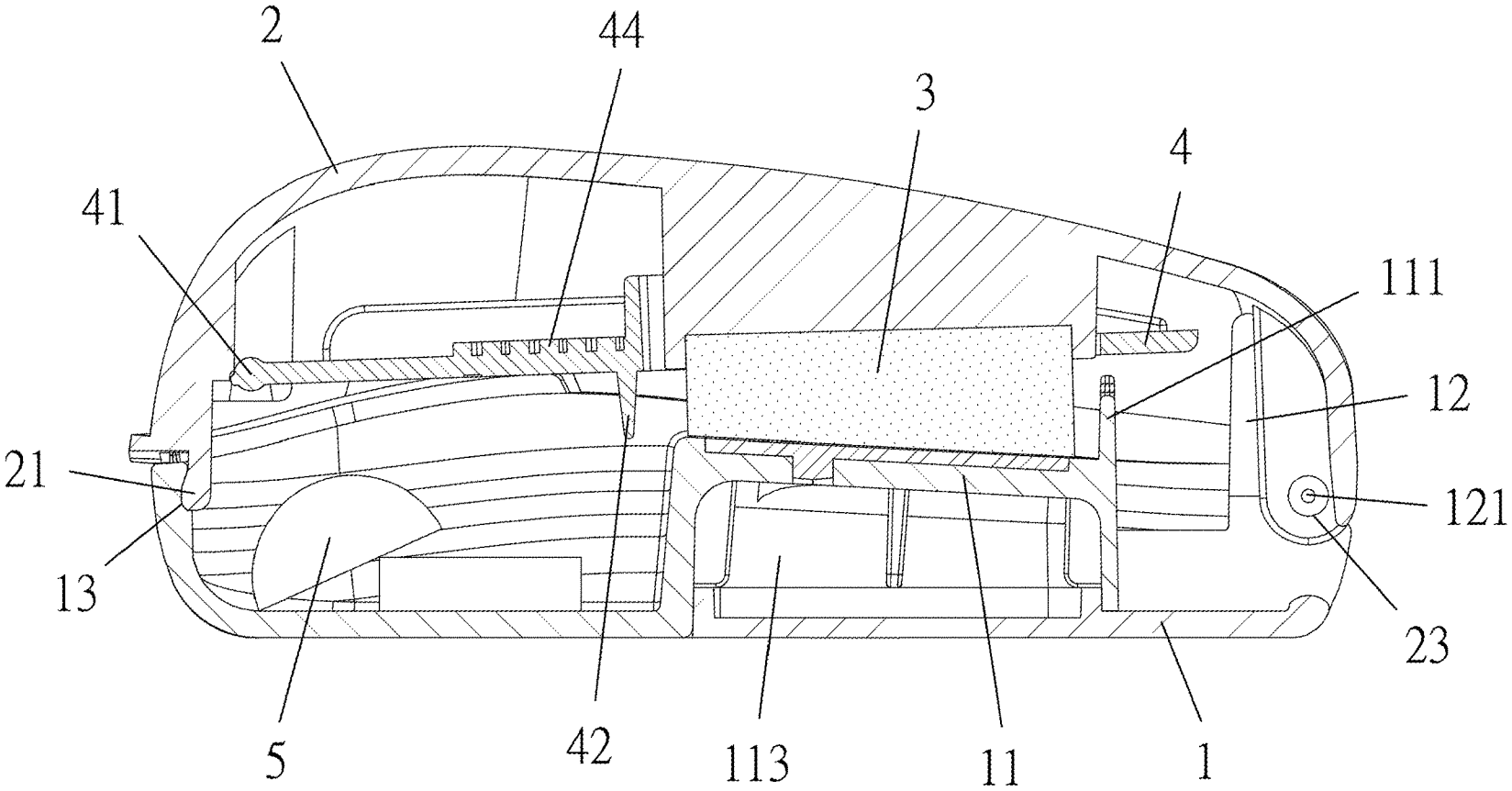
FIG. 10 is a sectional diagram showing an operation scenario of the tablet cutting device of FIG. 1.
Figure 11:
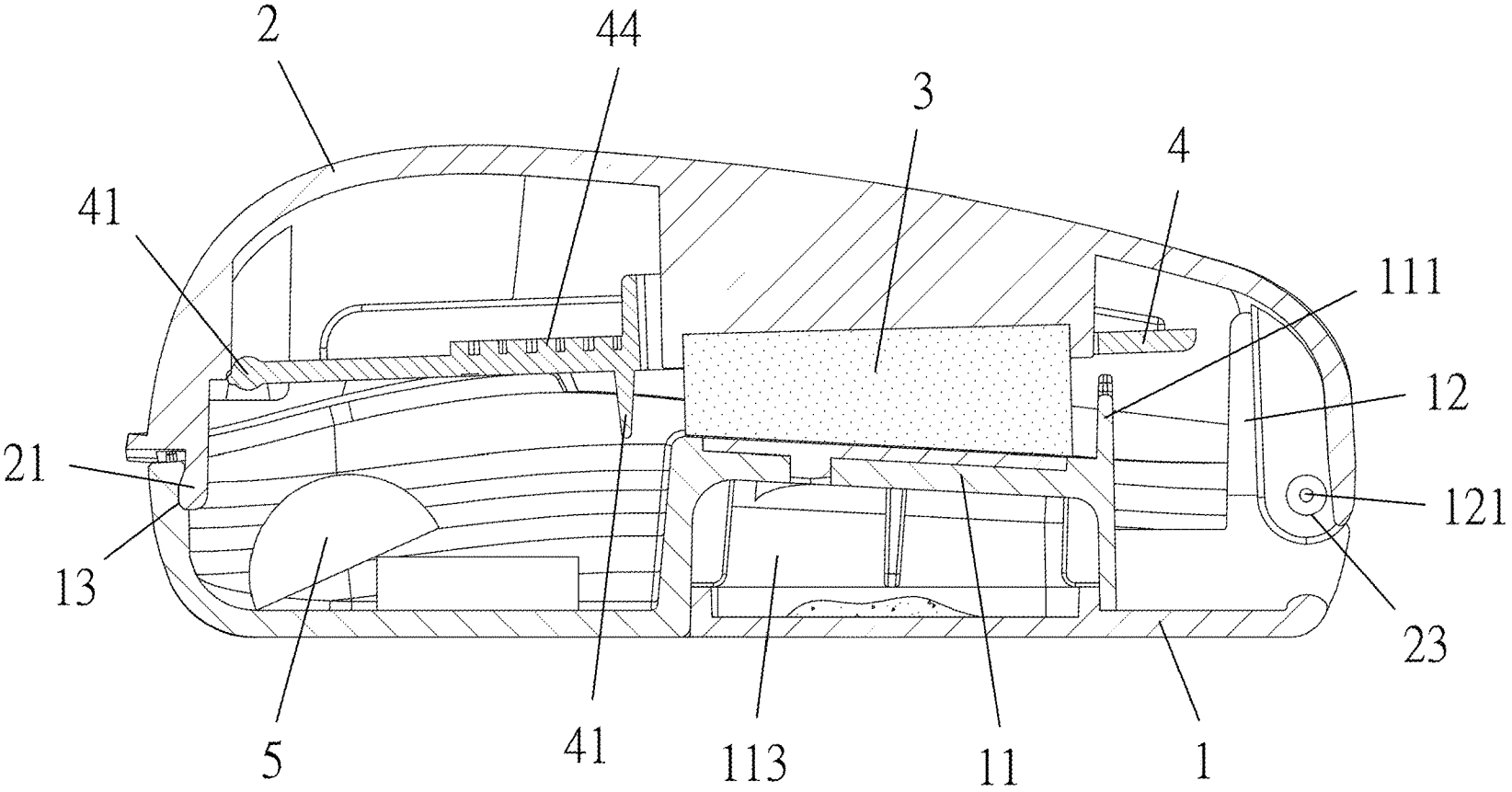
FIG. 11 is a sectional diagram showing a cut tablet being stored by the tablet cutting device of FIG. 1.

As shown in FIG. 9, to enhance the durability of the suspension body 4, at least a reinforcement element 44 is provided on a top side adjacent to the back end of the suspension body 4.

As shown in FIGS. 5, 9, 10, and 11, a slot opening 45 is provided on the suspension body 4 beneath the cutter 3 so that the cutter may penetrate through the slot opening 45 and reach the platform 11.

As shown in FIGS. 4, 7 to 11, a tablet 5 is placed on the platform 11 and is effectively positioned by the stopper 112. When the cover 2 is closed, the back end of the suspension body 4 falls and presses against the first positioning element 111, and is gradually raised towards the cover 2. In the meantime, the slot opening 45 moves closer to the cutter 3 until the cutter 3 runs through the slot opening 45. When the cover 2 completely seals the container 1, the first and second fastening elements 13 and 21 engage each other, and the cutter 3 splits the tablet 5. The split tablet 5 may be kept in the accommodation space of the container 1. The crumbs of the tablet 5 are collected by the chamber 113 beneath the platform 11.

When the cover 2 is opened, the back end of the suspension body 4 again naturally falls and presses against the first positioning element 111. As the cover 2 is raised farther away from the container 1, the cutter 3 is gradually moved away from the slot opening 45. Once the cover 2 is completely opened, the cutter 3 is entirely concealed by the suspension body 4. The back end of the suspension body 4 is confined by the second positioning element 12 and does not move towards the cover 2.

Figure 7:
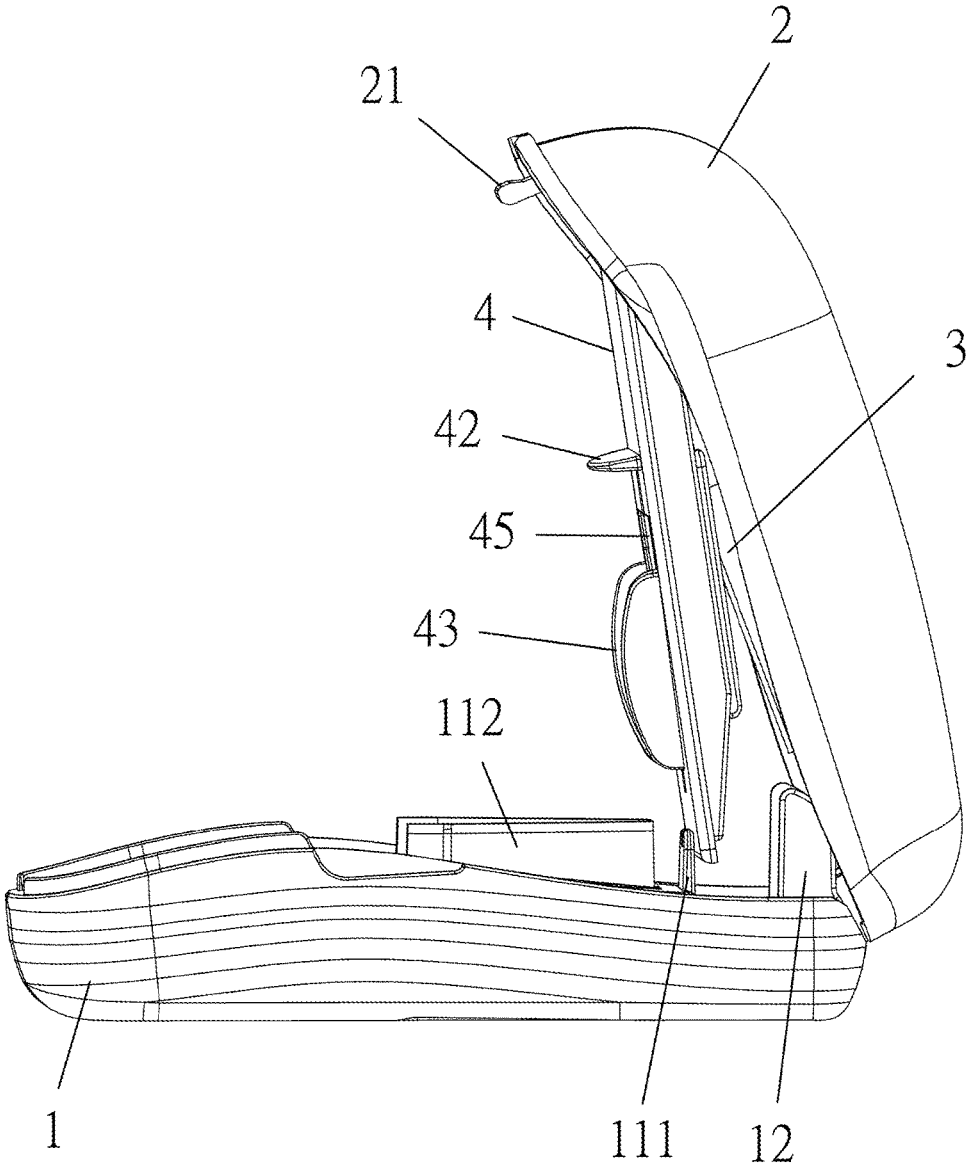
FIG. 7 is a side-view diagram showing the tablet cutting device of FIG. 1 when its cover is to be closed.
Figure 8:
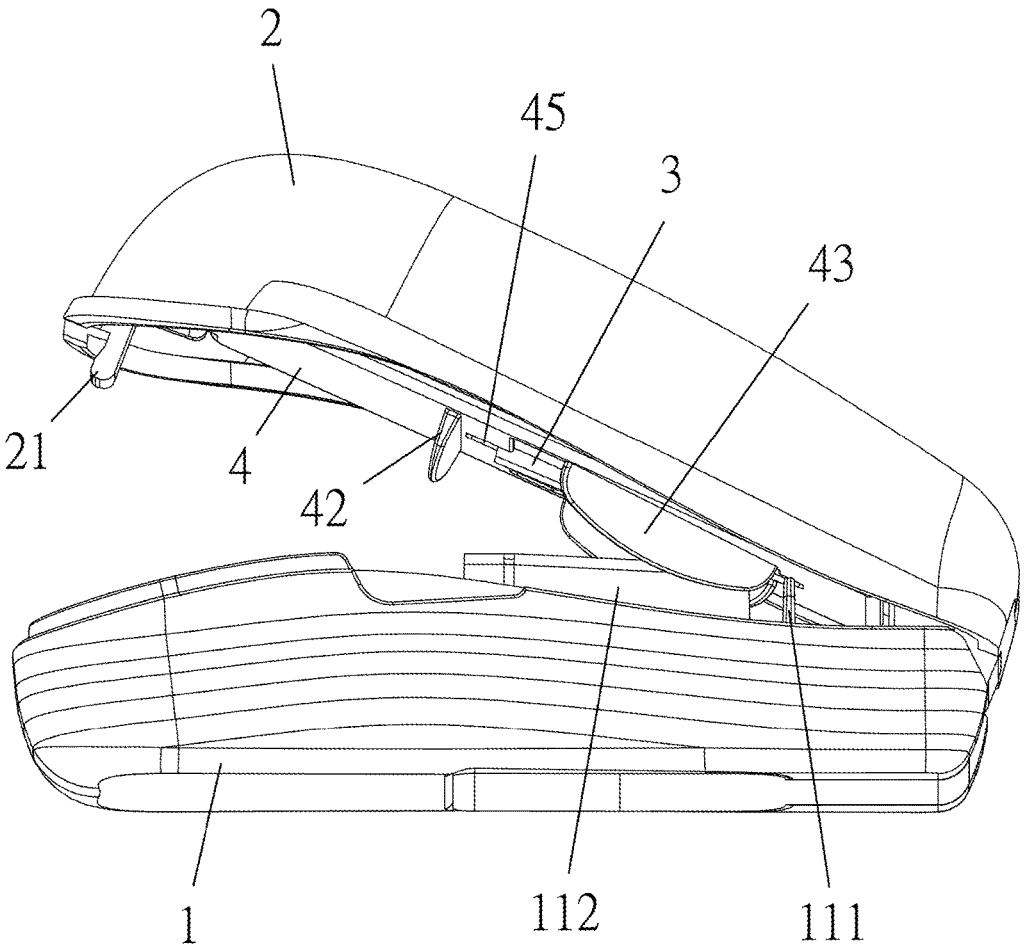
FIG. 8 is a side-view diagram showing the tablet cutting device of FIG. 1 when its cover is partially closed.

In other words, in the process of opening or closing the cover 2, the back end of the suspension body 4 is confined between the first and second positioning elements 111 and 12 so that the cutter 3 is concealed behind the suspension body 4, as shown in FIG. 7. Therefore, the user is protected from being cut by an exposed cutter 3.

The main advantages of the present invention lie in that the tablet cutting device has a small form factor, and enhanced safety as the cutter 3 is concealed behind the suspension body 4. Through the first and second positioning elements 111 and 12, the movement of the suspension body 4 is confined, so that the cutter 3 is concealed and that the suspension body 4 does not interfere the closing of the cover 2. Furthermore, the cutter 3 is configured on the inside of the cover 2, and therefore is structurally more stable and provides a better cutting effect.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A safe tablet cutting device, comprising a container, where a top side of the container is opened and the other sides of the container are enclosed, thereby forming an accommodation space; a platform is provided in the container for placing a tablet; a first positioning element is disposed to a back end of the platform, a second positioning element is disposed in the accommodation space between the first positioning element and a back end of the container, and a first fastening element is provided at a front end of the container;

a cover, where a back end of the cover is hinged to the back end of the container so that the cover selectively opens or closes the accommodation space, a second fastening element is provided at a front end of the cover for detachably engaging the first fastening element, and two axle holes are provided on the inside of the cover adjacent to the second fastening element;

a cutter provided on the inside of the cover where, when the cover closes the container, the cutter is pushed towards the platform; and a suspension body, where a front end of the suspension body is configured with an axle having two ends which are joined to the axle holes, respectively, the suspension body swivels around the axle, a back end of the suspension body is confined between the first and second positioning elements and when the cover is opened, and a slot opening is provided on the suspension body beneath the cutter so that the cutter penetrates the slot opening and reaches the platform when the cover is closed.

2. The safe tablet cutting device according to claim 1, wherein a V-shaped stopper is disposed on a top side of the platform for positioning the tablet; a bottom side of the suspension body that faces the platform is configured with a first protection element and two second protection elements; and, when the cover closes the container, the first protection element is adjacent to a front end of the platform and the second protection elements are outside the stopper.

3. The safe tablet cutting device according to claim 2, wherein at least a reinforcement element is provided on a top side adjacent to the back end of the suspension body.

4. The safe tablet cutting device according to claim 1, wherein a compartment is provided inside the container beneath the platform.

5. The safe tablet cutting device according to claim 4, wherein the platform and the stopper are made of an anti-slippery material.

6. The safe tablet cutting device according to claim 1, wherein the first positioning element is a flat piece extended upward from the back end of the platform.

7. The safe tablet cutting device according to claim 1, wherein the second positioning element comprises two opposite flat pieces separated at a distance.

8. The safe tablet cutting device according to claim 7, wherein a first pivot element is provided on the second positioning element; a second pivot element is configured at the front end of the cover; the first and second pivot elements are pivotally coupled so that the cover is hinged to the container and that the container is selectively covered or closed by the cover.

9. The safe tablet cutting device according to claim 8, wherein the first pivot element comprises two axle holes, one on each flat piece of the second positioning element; and the second pivot element is an axle whose two ends are plugged into the axle holes, respectively.

* * * * *